United States Patent [19]

Nemoto

[11] 4,155,370

[45] May 22, 1979

[54] WIG ANCHORAGE

[75] Inventor: Nobuo Nemoto, Chofu, Japan

[73] Assignee: Aderans Company, Ltd., Tokyo, Japan

[21] Appl. No.: 837,202

[22] Filed: Sep. 27, 1977

[30] Foreign Application Priority Data

Sep. 30, 1976 [JP] Japan ..... 51/117531

[51] Int. Cl.[2] ..... A41G 3/00

[52] U.S. Cl. ..... 132/53

[58] Field of Search ..... 132/53, 54, 5, 46 T, 132/48 R

[56] References Cited

U.S. PATENT DOCUMENTS

| | | | |
|---|---|---|---|
| 1,618,385 | 2/1927 | Pearson | 132/48 A |
| 1,900,970 | 3/1933 | Alimena et al. | 132/48 A |
| 3,669,129 | 6/1972 | Serebrin | 132/46 R |
| 3,699,978 | 10/1972 | Holly | 132/53 |

*Primary Examiner*—G. E. McNeil

*Attorney, Agent, or Firm*—Cantor and Singer

[57] ABSTRACT

A wig for covering up a bald area of the head or portion having thin hair and an improved wig anchoring technique. The anchoring member to be positioned on an inner surface of a wig body includes a curved reversible member supporting a number of pectinate projections having free ends movable toward or away from the reversible members as a result of opening or closing movement of the member so that, in use, closure of the reversible member will cause hair of the user to be gripped between the projections and the reversible member whereby to retain the wig on the user's head. The wig comprising a body having hair on an outer surface thereof and a plurality of the thus constructed anchoring members will not be easily dislodged from the user's head even though the user may perform strenuous exercise.

7 Claims, 7 Drawing Figures

WIG ANCHORAGE

BACKGROUND OF THE INVENTION

The wig for covering up a thinly-haired portion or bald area of the head is well known and is usually anchored to the head by means of an adhesive applied directly to an inner surface of the wig, by means of a velvet type fastener or by fastening the wig to hair growing around the periphery of the bald area. The present invention is concerned with improvements in the latter anchoring technique.

According to one aspect of the invention, there is provided a wig anchoring member to be positioned on an inner surface of a wig body, said anchoring member including a curved reversible member supporting a number of pectinate projections having free ends movable towards or away from the reversible member as a result of opening or closing movement of the member so that, in use, closure of the reversible member will cause hair of the user to be gripped between the projections and the reversible member whereby to retain the wig on the user's head.

Preferably, the reversible member includes two legs of which one supports the projections and the other of which includes a friction surface towards which the free ends of the projections move during closing movement of the reversible member. The legs may be formed from resilient metal sheet, and the projections may be formed from resilient metal wire. The projections are preferably corrugated to improve the grip of the projections on the user's hair. The free end of each projection may be of part spherical form and the other end flattened and attached to the reversible member.

The friction surface is preferably defined by a resilient layer of material.

If desired, the reversible member and projections may be integral and formed from resilient synthetic plastics material.

According to another aspect of the invention, there is provided a wig comprising a body having hair on an outer surface thereof, and a plurality of anchoring members on an inner surface thereof, each said anchoring member including a curved reversible member supporting a number of pectinate projections having free ends movable towards or away from the reversible member as a result of opening or closing movement of the member so that, in use, closure of each said reversible member will cause hair of the user to be gripped between the projections and their respective reversible members whereby to retain the wig on the user's head.

SUMMARY OF THE INVENTION

The present invention relates to improvements in wig anchorage, and particularly, but not exclusively, to anchorage of a toupee (hereinafter referred to as a wig) for covering a thinly-haired portion of the head or a bald area from which hair has been lost.

BRIEF DESCRIPTION OF THE ACCOMPANYING DRAWINGS

A wig and anchoring member in accordance with the invention will now be described by way of example with reference to the accompanying drawings in which.

DETAIL DESCRIPTION OF THE INVENTION

Referring firstly to FIGS. 1 to 4, a wig 1 has a wig body 2 formed either from a soft synthetic resin material of suitable thickness or an alternative material such as highly flexible cloth. A plurality of anchoring members 3 are provided in the inner surface of the wig body 2 at desired positions.

The wig body 2 has hairs 4 grafted on to its outer surface and is designed so that it will be difficult to tell from its appearance, when in use, whether it is covering up a bald or thinly-haired area of the head.

Figure 1:
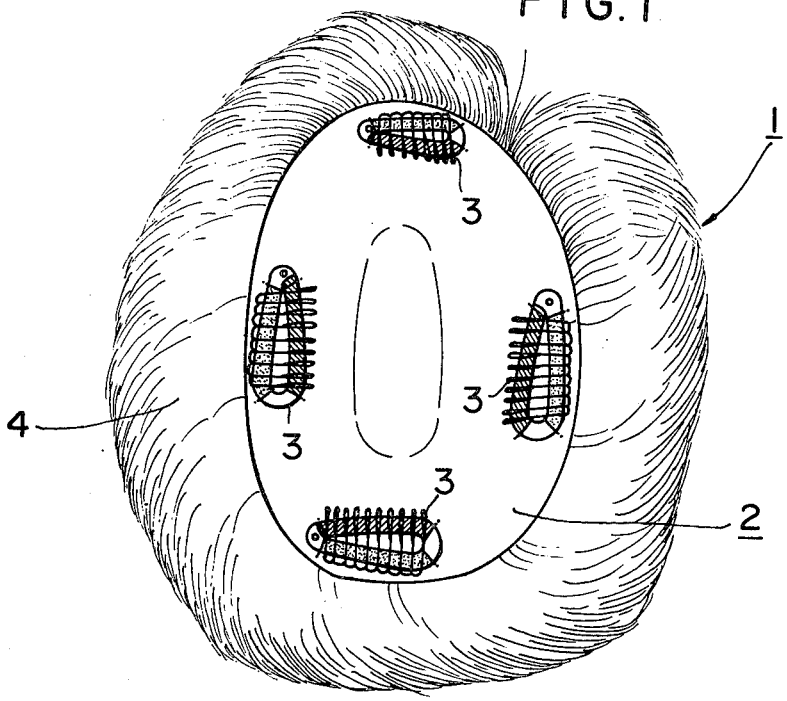
FIG. 1 is a plan view showing a preferred form of wig according to the invention.
Figure 2:
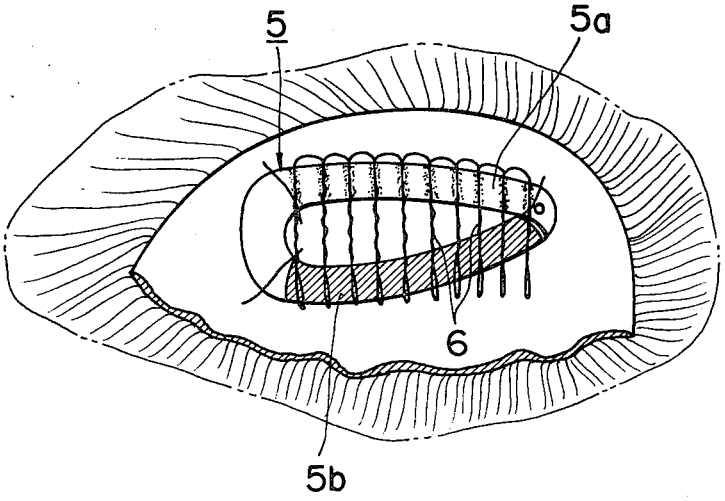
FIG. 2 is a partially enlarged plan view of an anchoring member mounted on the wig of FIG. 1.

As shown in FIG. 2, the anchoring members 3 are mounted on the periphery of the wig body 2 either by bonding their ends to the wig body 2 by means of an adhesive or by stitching the ends to the wig body. Each anchoring member 3 comprises a curved reversible member 5. A number of projections 6 are connected pectinately to one leg piece 5*a* of said curved reversible member 5, and a frictional member 7 is formed on another leg piece 5*b* of the member 5. The projections 6 can be made to engage or disengage the frictional member 7 by moving the reversible member from the position shown in FIG. 3 to the position shown in FIG. 4 or vice-versa.

The curved reversible member 5 is preferably a thin plate formed from a highly flexible metal sheet or from synthetic resin material which will remain in the position into which it is bent during reversing movement. That is, when upward finger-pressure is applied to the central portion of the curved reversible member 5 when in FIG. 4 position, the member 5 will be reversed upwardly to the FIG. 3 position. When subsequent downward finger-pressure is applied to the curved reversible member 5, the member will reverse downwardly and resume the FIG. 4 position.

The reversing characteristic of the member 5 is achieved by forming the aforesaid thin plate into a U-shaped configuration , and overlapping its free ends before joining them together. The projections 6 are formed by bending or twisting a springy material such as steel wire, and by fixing end portions thereof to the leg piece 5*a* by solvent welding or by means of synthetic resin adhesive so as to leave the free ends overlying the leg piece 5*b*.

Figure 7:
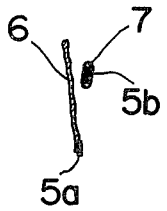
FIG. 7 is a longitudinal sectional view taken along line A—A in FIG. 5.
Figure 4:
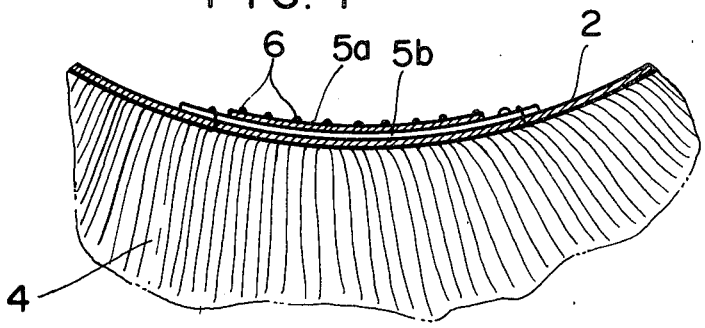
FIG. 4 is a side view showing the anchoring member of FIG. 2 in a closed position.
Figure 5:
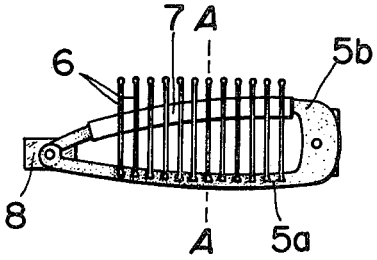
FIG. 5 is a plan view showing an alternative form of anchoring member in accordance with the invention.
Figure 6:
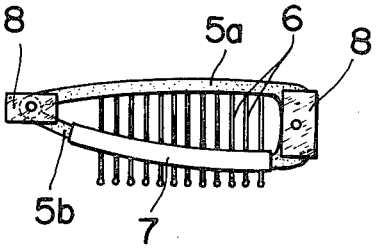
FIG. 6 is an underplan view of the anchoring member shown in FIG. 5.

As shown in FIG. 5 or 6, the projections 6 may instead be formed by cutting a springy metallic material such as steel wire into the required number of given lengths, forming one end of each wire into a generally spherical configuration, and expanding and flattening its rear end. Each wire 6 is formed with corrugations in the plane of reversing movement (see FIG. 7). A number of such projections are pectinately secured to the reversible member by their expanded and flattened ends by solvent welding. Attachment pieces 8 are provided at each end of the reversible member for attachment to the wig body 2. The use of the FIGS. 5 and 6 construction improves the anchorage of the wig on the user's head since the user's hair will follow the corrugations in the wires 6.

If desired, the entire anchoring member 3 may be formed from a synthetic resin material, the projections 6 being integral with the member 5 in such a case. Where separate projections are provided, it is simply a matter of choice as to the leg on which the projections and the frictional member 7 are mounted.

Figure 3:
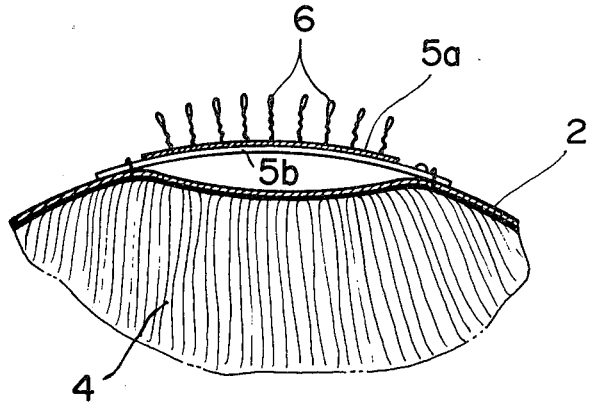
FIG. 3 is a side view showing the anchoring member of FIG. 2 in an open position.

In use, each anchoring member 3 is firstly moved into its open position as shown in FIG. 3. Thereafter, the wig is placed on the user's head centering around the bald or thin-haired area of the head. Each of the anchoring members is then reversed and thereby closed by applying finger-pressure to both its ends. Therefore, when the wig is put on the user's head with the anchoring members 3 open, the projections 6 and the user's hair intercalate. Subsequent closure of the anchoring member 3 by applying finger-pressure thereto presses the projections 6 against the frictional portion 7 to positively grip the intercalated hairs around the periphery of the bald or thin-haired area. Thus, the wig will not be easily dislodged from the user's head even though the user may perform strenuous exercise.

In order to remove the wig, finger pressure is applied to the central portion of each curved reversible member 5 so as to reverse it. In this manner, the member 5 will move into the FIG. 3 position and projections 6 will disengage the frictional member 7. Thereafter, the wig can be easily removed from the head.

The present invention has various advantages over known wig anchorage techniques in that fitting or removal of the wig is effected by means of touch, and its grip on the user's hair ensures both snug and secure fitting on the head, so that the user can wear the wig without fear of it becoming dislodged even during strenuous exercise.

A wig in accordance with the invention may be used either as a toupee or as a wig for covering a large bald area of the head provided that there is sufficient peripheral hair for gripping by the anchoring members 3.

What is claimed is:

1. A wig anchoring member to be positioned on an inner surface of a wig body, said anchoring member including a curved reversible member having two legs, one of said legs supporting a number of corrugated pectinate projections having free ends moving toward or away from the reversible member as a result of opening or closing movement of the member so that, in use, closure of the reversible member will cause hair of the user to be gripped between the projections and the reversible member whereby to retain the wig on the user's head, and the other of said legs including a friction surface towards which the free ends of the projections move during closing movement of the reversible member, said friction surface being defined by a resilent layer of material, said material being an oil-resistent rubber tube fitted over said other leg.

2. A wig anchoring member, according to claim 1, in which the legs are formed from resilient metal sheet and the projections are formed from resilient metal wire.

3. A wig anchoring member, according to claim 2, in which the free end of each projection is of part-spherical form, and the other end is flattened and attached to the reversible member.

4. A wig anchoring member, according to claim 1, in which the reversible member and projections are integral and formed from resilient synthetic plastics material.

5. A wig anchoring member, according to claim 1 to 4, in which the two legs are joined together at their ends and are arranged to be secured at their ends to the inner surface of the wig.

6. A wig anchoring member, according to claim 2, in which the metal legs are joined together at their ends and support attachment pieces by which the reversible member is to be secured to the inner surface of the wig.

7. A wig comprising a body having hair on an outer surface thereof, and a plurality of anchoring members on an inner surface thereof, each said anchoring member including a curved reversible member having two legs, one of said legs supporting a number of corrugated pectinate projections have free ends movable towards or away from the reversible member as a result of opening or closing movement of the member so that, in use, closure of each said reversible member will cause hair of the user to be gripped between the projections and their respective reversible members whereby to retain the wig on the user's head, and the other of said legs including a friction surface toward which the free ends of the projections move during closing movement of the reversible member, said friction surface being defined by a resilient layer of material, said material being an oil-resistant rubber tube fitted over said other leg.

* * * * *